US008677781B2

(12) United States Patent
Stoilas

(10) Patent No.: US 8,677,781 B2
(45) Date of Patent: Mar. 25, 2014

(54) DEVICE AND METHOD FOR PIERCING ENLARGEMENT

(76) Inventor: Ilias Stoilas, Wayne, NJ (US)

( * ) Notice: Subject to any disclaimer, the term of this patent is extended or adjusted under 35 U.S.C. 154(b) by 141 days.

(21) Appl. No.: 13/023,036

(22) Filed: Feb. 8, 2011

(65) Prior Publication Data

US 2012/0198886 A1 Aug. 9, 2012

(51) Int. Cl.
*A44C 7/00* (2006.01)

(52) U.S. Cl.
USPC ..... 63/12; 63/33

(58) Field of Classification Search
USPC ..... 63/33, 12, 40; 24/458; 16/2.1; 604/164.03; 411/339; 606/188
See application file for complete search history.

(56) References Cited

U.S. PATENT DOCUMENTS

| | | | | | |
|---|---|---|---|---|---|
| 2,713,863 | A * | 7/1955 | Handerson | 606/188 |
| 4,501,050 | A * | 2/1985 | Fountoulakis | 24/705 |
| 4,507,344 | A * | 3/1985 | Baughman | 428/99 |
| 4,850,771 | A * | 7/1989 | Hurd | 411/43 |
| 5,018,365 | A * | 5/1991 | Luceno | 63/12 |
| 5,309,737 | A * | 5/1994 | Fountoulakis | 63/12 |
| 5,411,516 | A * | 5/1995 | Thomas | 606/188 |
| 5,454,829 | A * | 10/1995 | Koland | 606/188 |
| 5,743,113 | A * | 4/1998 | Kogen | 63/12 |
| 5,855,587 | A * | 1/1999 | Hyon et al. | 606/188 |
| 6,105,392 | A * | 8/2000 | Biagi | 63/12 |
| 6,138,333 | A * | 10/2000 | Hollingworth | 24/705 |
| 2003/0195543 | A1 * | 10/2003 | Danno | 606/188 |
| 2010/0147025 | A1 * | 6/2010 | Simpson et al. | 63/13 |

OTHER PUBLICATIONS

"Ultimate Ear Stretching Plug Kit (0g—1 inch)", Jan. 29, 2010, Kingsbodyjewelry.com, pp. 1-2.*

* cited by examiner

*Primary Examiner* — Victor Batson
*Assistant Examiner* — Abigail Morrell
(74) *Attorney, Agent, or Firm* — Donald J. Ranft; Collen IP

(57) ABSTRACT

A device and method is provided to enable the enlargement of a piercing to a desired diameter. The device includes a series of units with each unit consisting of a plug body, a front end cap and a rear end cap and each unit increasing in size compared to the previous unit in the series. Each unit is able to securely attach to the previous unit and enable it to push the previous unit out of the piercing as it is pushed into the piercing.

7 Claims, 7 Drawing Sheets

DEVICE AND METHOD FOR PIERCING ENLARGEMENT

BACKGROUND

Stretching a piercing enlarges the opening of the piercing to accommodate larger sized jewelry. It is possible to use a scalpel or dermal punch to cut ears to a large gauge hole right away, but that process is generally illegal in most states and often removes too much tissue from the earlobe, making the procedure very hard to reverse. Another popular method is to force a larger piece of jewelry into the hole, but this is generally very painful and causes a great deal of damage to the tissue. The problem with this method is that the jewelry often contains sharp edges which can damage the skin around the piercing or the jewelry size difference is too great and abrupt, which can also damage the skin around the piercing.

Another method is to push an insertion taper through the ear piercing and then transferring a piece of jewelry into the piercing by using the jewelry to push out the insertion taper. One problem with this method is that the insertion taper sizes are based on the American Wire Gauge Standard, so the size difference from one gauge to the other can be too great, which can damage the skin around the piercing during a stretch. Another issue with this method is that it requires a professional to perform the procedure. In addition during the transfer process, since there is no stable connection between the jewelry and insertion taper, often the connection is lost and the jewelry is not inserted which means another attempt to insert has to be made, which causes damage to the tissue around the piercing.

SUMMARY

To overcome the problems with existing methods for enlarging piercings, a new device and method is provided. A series of interconnecting pieces are used to safely and systematically enlarge a piercing.

DETAILED DESCRIPTION

Figure 1:
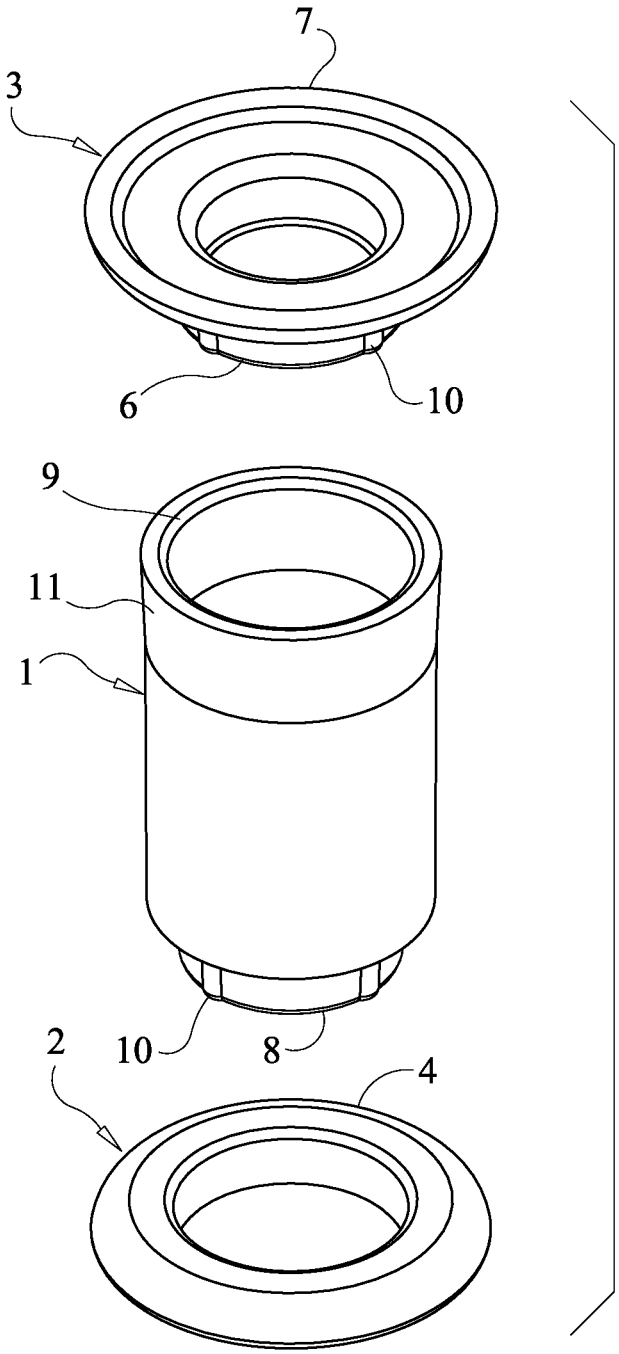
FIG. 1 is a front top perspective view of the 3 components of an individual unit.
Figure 2:
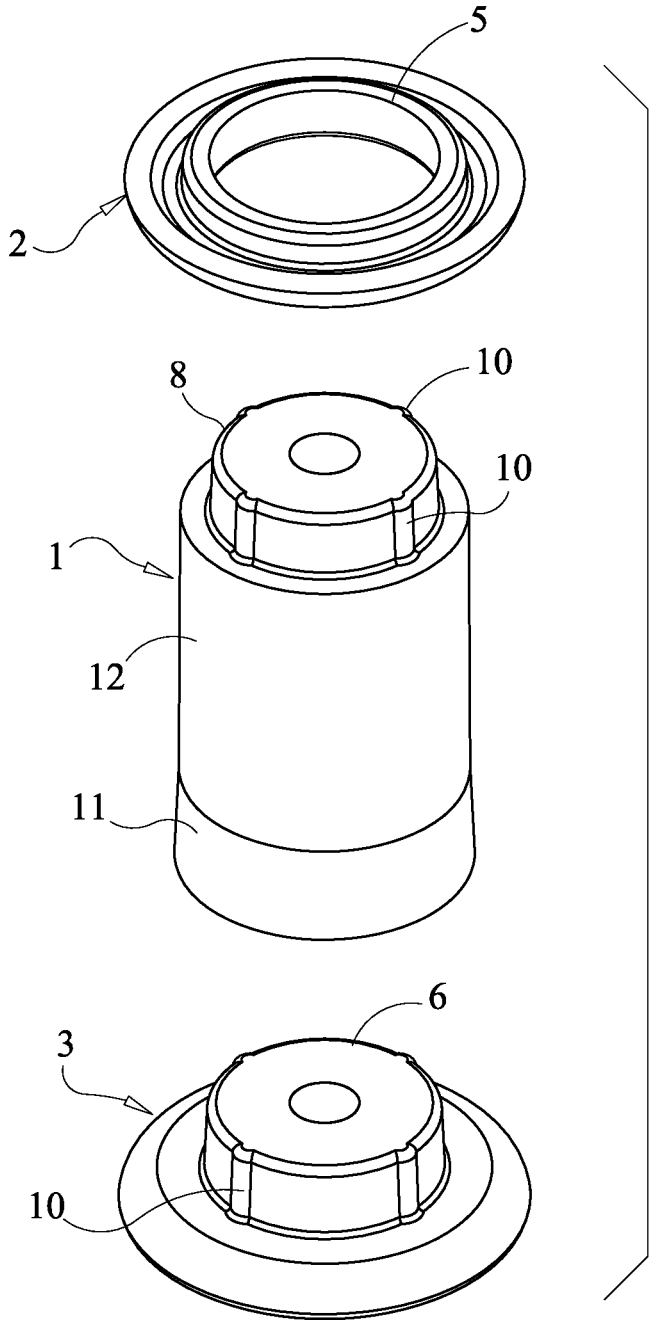
FIG. 2 is a front bottom perspective view of the 3 components of an individual unit.
Figure 3:
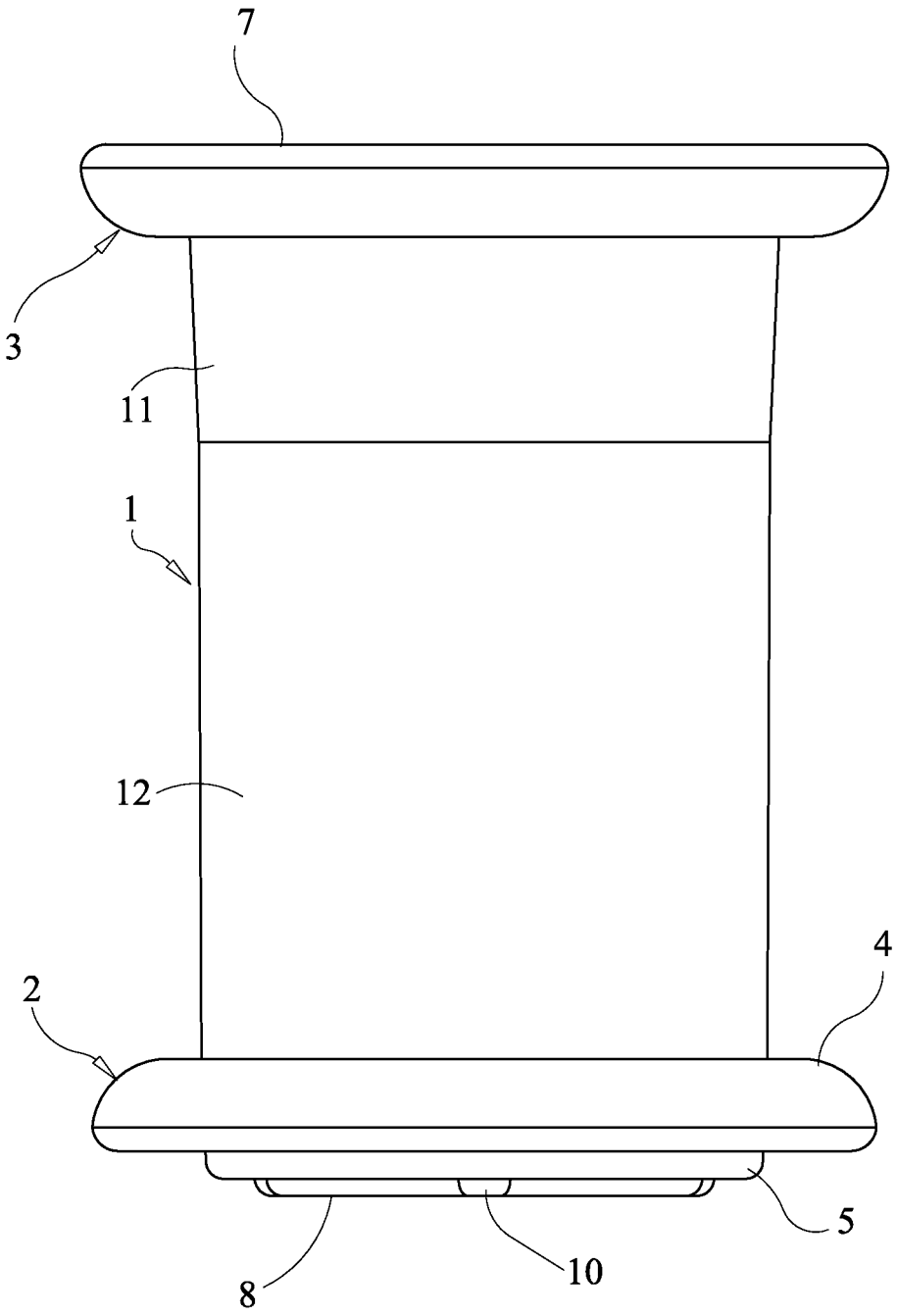
FIG. 3 is a front view of the 3 components assembled.
Figure 4:
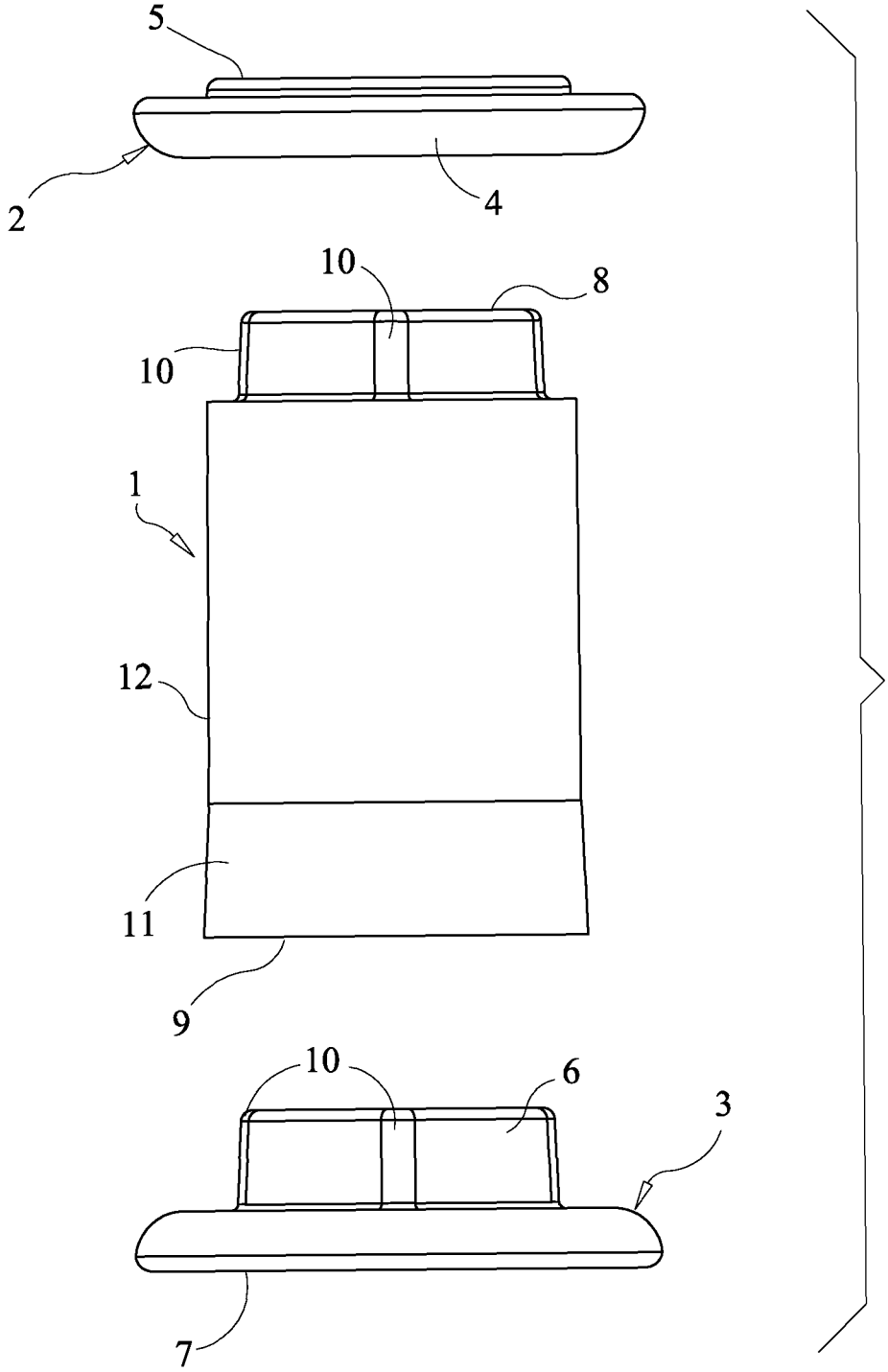
FIG. 4 is a front bottom view of the 3 components of an individual unit.
Figure 5:
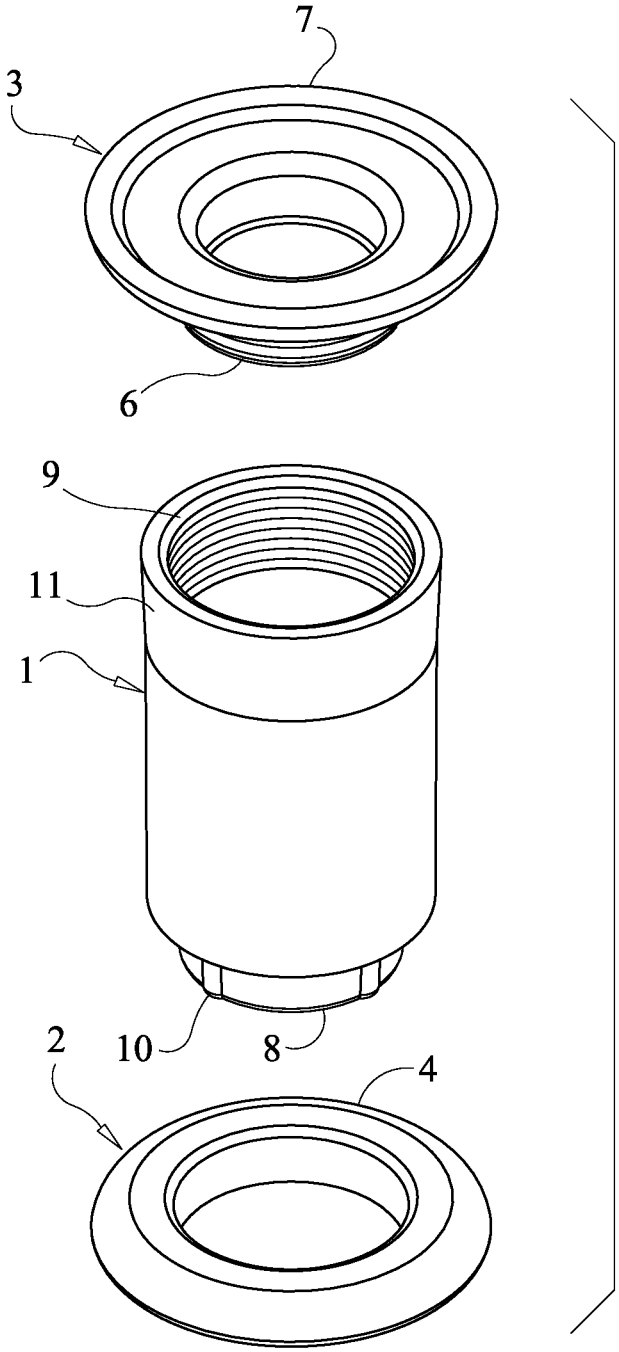
FIG. 5 is a front top perspective view of another embodiment with the end cap designed for connection to the plug body by screwing them together.
Figure 6:
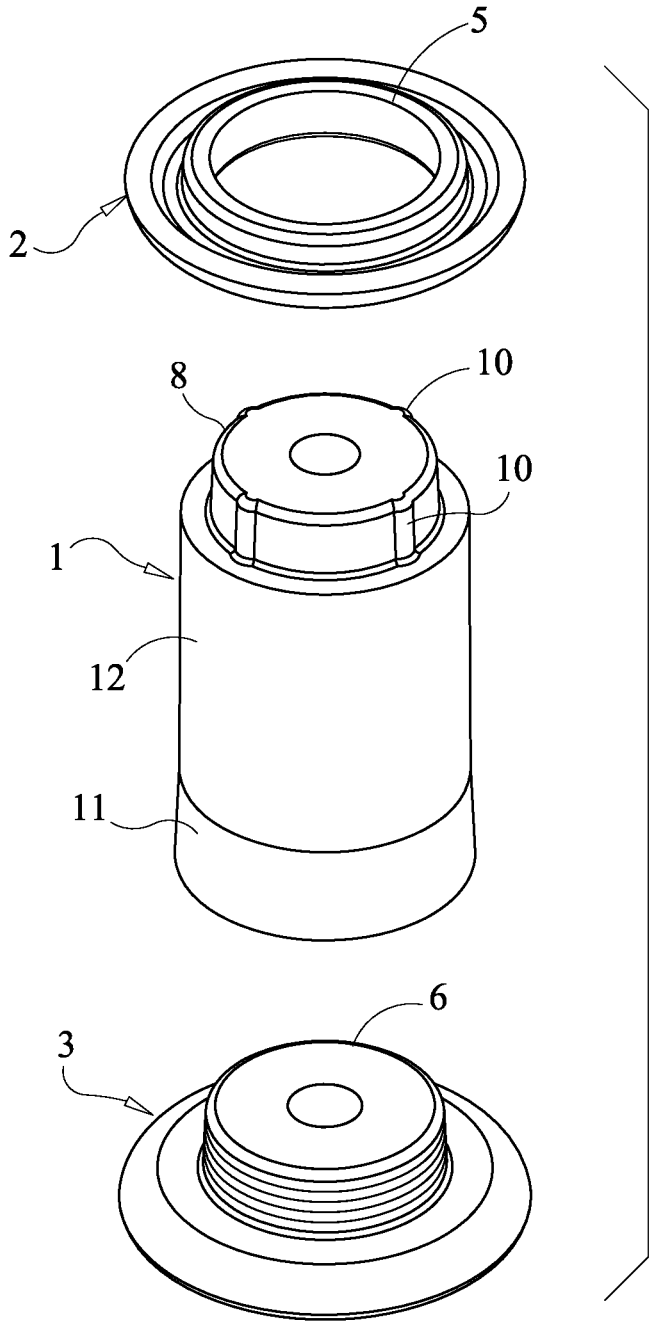
FIG. 6 is a bottom perspective view of another embodiment with the end cap designed for connection to the plug body by screwing them together.
Figure 7:
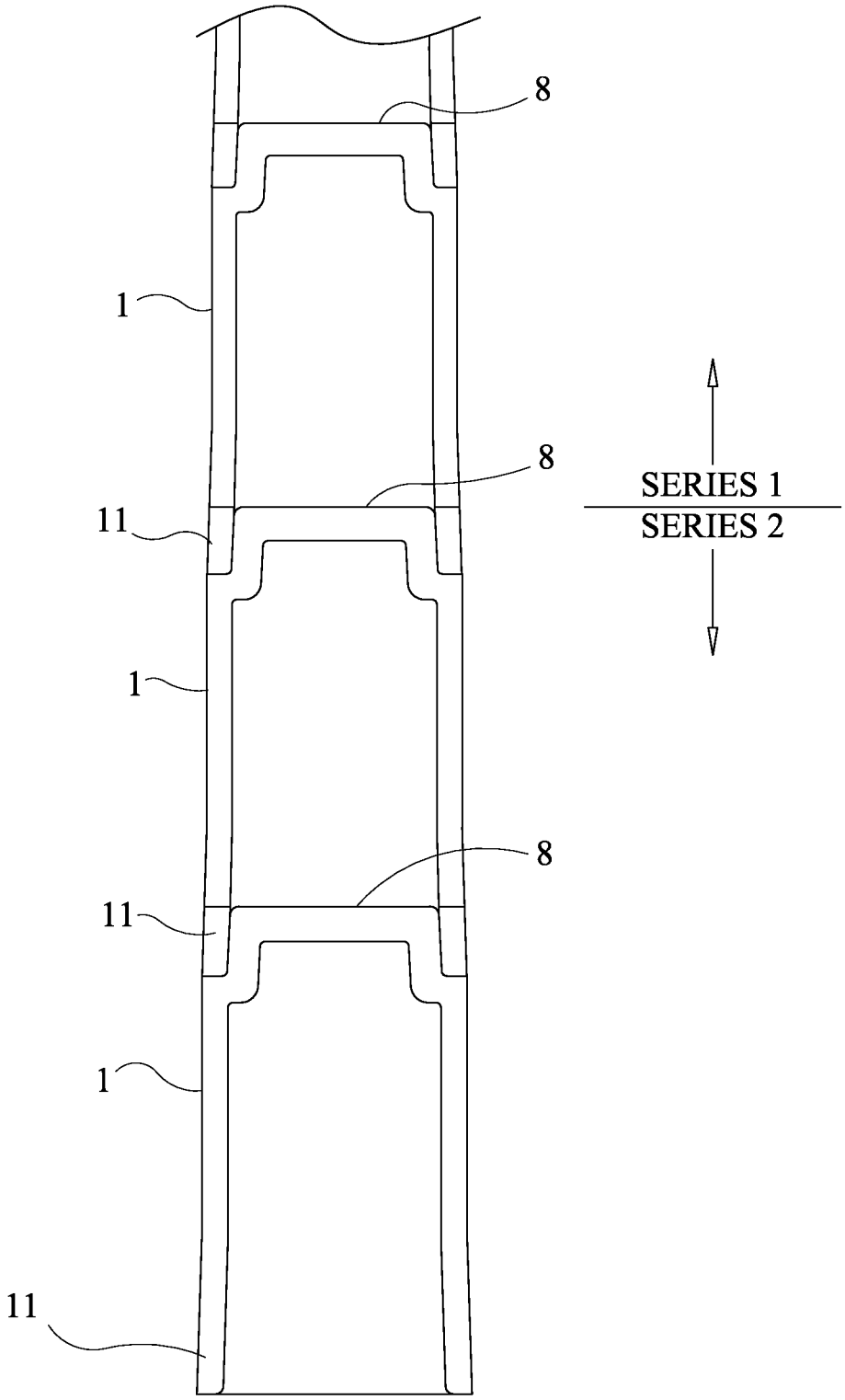
FIG. 7 illustrates the increasing size of each successive plug body including when starting a new series of units.

To overcome the problems with existing methods for enlarging piercings a carefully constructed series of plugs are sequentially installed into the piercing. As depicted in FIG. 1, each plug or unit consists of three parts: a plug body (1), a front end cap (2), and a back end cap (3). The front end cap (2) is configured with a female end (4) opposite an outer cap end (5). The back end cap (3) is configured with a male end (6) opposite an outer cap end (7). The plug body (1) is configured with a male end (8) opposite and female end (9). The female end (9) is also flared to a wider diameter (11) than the main section(12) of the plug body (1). Ridges (10) on the male portions of the unit body (1) and back end cap (3) are provided to facilitate a friction fitting when pushed into the female portions of the unit body (1) and front end cap (2). The number of ridges can be varied as warranted. Other means to secure these parts can also be used such as screw threads for screwing together.

These plugs are designed to be used as a set with each plug in the set to be inserted sequentially. Each plug in the set is designed so that equal incremental expansion of the piercing is accomplished with all the plugs in a series designed for the desired told expansion. To minimize possible damage to the skin, the growth in size in each consecutive plug in a series is limited to less than 1.6 mm. Each plug in a series is designed to be able to connect with the smaller and larger sized adjacent plugs in the series. Each series could include as many plugs as warranted for a particular situation but typically a series would include ten units/plugs.

For example, Series 1 starts with unit 1.1 which has a body with a diameter of 5.189 mm and a circumference of 16.3 mm. The next unit in the series is 1.2 which has a body with a diameter of 5.529 mm and a circumference of 17.3 mm. The next unit in the series is 1.3 which has a body with a diameter of 5.87 mm and a circumference of about 18.3 mm. This approximate equal growth in circumference is kept the same in between each of the 10 units of each series. Series 1 will have a growth in circumference between each unit body of about 1 mm. The growth of circumference between the units in each series is approximately the same, but the growth in circumference between each series does not have to be the same. The first and last unit of each series has a size that is directly based on common body jewelry sizes.

Common body jewelry sizes are based on the 'American Wire Gauge' standard and utilize the scale from 20 gauge to 00 gauge. After 00 gauge jewelry is most commonly measured using the US measuring system or the metric system. Series 1 starts with a unit (1.1) that has a body diameter of 5.189 mm, which is the same as 4 gauge, and ends with a unit (1.10) that has a body diameter of 8.252 mm, which is the same as 0 gauge. Series 2 starts a unit (2.1) that has a body diameter of 8.252 mm, which is the same as 0 gauge, and ends with a unit (2.10) that has a body diameter of 12.7 mm, which is the same as ½". The last unit of each series is the same size as the first unit in the next sequential series.

Each plug body (1) is cylindrical in shape, and typically approximately 12 mm long with a 3 mm ramp. The ramp grows to the diameter of the next unit body in the series. For example, unit body 1.1 has a diameter of 5.189 mm, but the ramp or flare has a diameter of 5.529 mm, which is the same as the body diameter of unit 1.2. Unit 1.2 which has a body diameter of 5.529 mm, has a ramp or flare with a diameter of 5.87 mm, which is the same diameter as the body of unit 1.3. This allows for smooth transitions between each unit body when the series is used as directed.

A Series of Units/Plugs is Used in the Following Manner:

- Front end cap (2) is removed from first unit in series (e.g. 1.1) and is inserted into piercing from the intended back of he piercing.
- After insertion the front cap (2) is snapped onto the body to close the jewelry and keep it in the piercing.
- The unit is worn for a predetermined time period (typically 10-30 days).
- After the time period elapses, the back end cap (3) from unit 1.1 is removed, exposing the "female" end of the body.

The front cap is removed from the next unit in the series (1.2) exposing the male end of the body.

The male end of unit 1.2 is inserted into the female end of unit 1.1 (which is still in the piercing) connecting the two units into one assembly.

The assembly consisting of unit 1.1 (still in the piercing) and unit 1.2 is pushed through the piercing, sliding unit 1.1 out of the piercing while simultaneously sliding unit 1.2 into the piercing.

At this point, unit 1.2 is in the piercing and unit 1.1 is out of the piercing but still connected as an assembly.

Unit 1.1 is disconnected from the assembly and discarded, leaving unit 1.2 in the piercing.

The front cap of unit 1.2 is snapped onto the body to close the jewelry and keep it in the piercing.

This unit is worn for the predetermined time period before repeating the same steps with the next unit in the series (1.3)

This process is repeated until the user reaches the last unit in the series, 1.10 in this case.

The above illustrates various concepts, structures and techniques which are the subject of this patent. It will now become apparent to those of ordinary skill in the art that other embodiments incorporating these concepts, structures and techniques may be used. Accordingly, it is submitted that that scope of the patent should not be limited to the described embodiments but rather should be limited only by the spirit and scope of the following claims. Examples of other embodiments are: a series of units can consist of more or less individual units than 10; the dimensions indicated in the example can be varied as warranted; and the number of days that a plug is left in place can be varied as warranted.

I claim the following:

1. A system for enlarging an existing body piercing, the system comprising:

at least three units of increasing size configured to be used in series, each unit comprising:

a plug body configured with a male end, a cylindrical main section, and a female end, the female end flared to a wider diameter than the diameter of the cylindrical main section of the plug body;

a front end cap designed to attach to the male end of the plug body and configured with a female end opposite an outer cap end;

a back end cap designed to attach to the female end of the plug body and configured with a male end opposite an outer cap end; and wherein the female end of each plug body is sized to receive the male end of the plug body of the next unit in the series; and wherein the at least three units are used in series to gradually expand the size of the existing body piercing by first inserting the smallest of the at least three units into the piercing, and then replacing the unit with increasingly larger units over an extended period of time.

2. The system according claim 1, wherein the sizing of the units is consistent with common body jewelry sizes.

3. The system according claim 1, wherein the male end of the plug body and the male end of the back end cap are configured with a minimum of three ridges.

4. The system according claim 1, wherein the male end of the plug body and the male end of the back end cap are configured with screw threads compatible with respective threads in the female end of the plug body and the female end of the front end cap.

5. A method for enlarging an existing body piercing, the method comprising:

creating a series of at least three units of increasing size, each unit comprising:

a plug body configured with a male end, a cylindrical main section, and a female end, the female end flared to a wider diameter than the diameter of the cylindrical main section of the plug body;

a front end cap designed to attach to the male end of the plug body and configured with a female end opposite an outer cap end;

a back end cap designed to attach to the female end of the plug body and configured with a male end opposite an outer cap end; and wherein the female end of each plug body is sized to receive the male end of the plug body of the next unit in the series;

selecting the first, smallest unit in the series;

removing the front end cap from the plug body of the first unit;

inserting the plug body into the existing body piercing;

snapping the front end cap onto the inserted plug body;

waiting for a predetermined time period;

removing the back end cap of the inserted unit;

removing the front end cap of the next unit in the series;

inserting the male end of the plug body of the next unit into the female end of the body plug of the first unit;

pushing the first unit out of the piercing by pushing the next unit into the piercing;

disconnecting the first unit from the now inserted next unit;

snapping the front end cap onto the inserted plug body;

waiting for a predetermined time period; and repeating the above steps for all the remaining units in the series.

6. The method according to claim 5, wherein the predetermined time period is between 10 and 30 days.

7. The method according to claim 5, wherein the sizing of the units is consistent with common body jewelry sizes.

* * * * *